US006851788B2

(12) United States Patent
Choi et al.

(10) Patent No.: US 6,851,788 B2
(45) Date of Patent: Feb. 8, 2005

(54) APPARATUS AND METHOD FOR DETECTING INK-DISCHARGE AMOUNT FOR CONTROLLING PRINTER MAINTENANCE

(75) Inventors: Kyung-chool Choi, Gyeonggi-do (KR); Young-bok Ju, Gyeonggi-do (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 3 days.

(21) Appl. No.: 10/622,121

(22) Filed: Jul. 18, 2003

(65) Prior Publication Data

US 2004/0085380 A1 May 6, 2004

(30) Foreign Application Priority Data

Jul. 23, 2002 (KR) ..... 10-2002-43280

(51) Int. Cl.[7] ..... B41J 29/393; B41J 2/165; B41J 2/195

(52) U.S. Cl. ..... 347/23; 347/7; 347/19

(58) Field of Search ..... 347/7, 19, 23

(56) References Cited

U.S. PATENT DOCUMENTS

| | | | | | |
|---|---|---|---|---|---|
| 4,550,327 | A | * | 10/1985 | Miyakawa | 347/67 |
| 5,617,121 | A | * | 4/1997 | Tachihara et al. | 347/7 |
| 5,856,834 | A | * | 1/1999 | Murphy, III | 347/23 |
| 5,929,875 | A | * | 7/1999 | Su et al. | 347/19 |
| 6,631,972 | B2 | * | 10/2003 | Yazawa | 347/23 |

* cited by examiner

*Primary Examiner*—Thinh Nguyen
*Assistant Examiner*—Julian D. Huffman
(74) *Attorney, Agent, or Firm*—Staas & Halsey LLP

(57) ABSTRACT

An apparatus detecting an amount of ink discharged by a printer, the printer having a plurality of heaters and corresponding nozzles and performing printing by applying pulses to the heaters to heat the heaters and discharge ink through the corresponding nozzles, the apparatus including a detector connected to the heaters that detects a state change of the heaters and output a state change signal; and an ink discharge amount calculator that calculates an amount of discharged ink corresponding to the state change output signal from the detector.

18 Claims, 4 Drawing Sheets

APPARATUS AND METHOD FOR DETECTING INK-DISCHARGE AMOUNT FOR CONTROLLING PRINTER MAINTENANCE

CROSS-REFERENCE TO RELATED APPLICATIONS

This application claims priority from Korean Patent Application No. 2002-43280, filed on Jul. 23, 2002, in the Korean Intellectual Property Office, the disclosure of which is incorporated herein in its entirety by reference.

BACKGROUND OF THE INVENTION

1. Field of the Invention

The present invention relates to printer maintenance, and, more particularly, to an apparatus and method for detecting an amount of discharged ink to control the maintenance of a printer.

2. Description of the Related Art

Inkjet printers generally have a head with a plurality of nozzles, each of which is arranged in a desired printing position, and printing is achieved by discharging ink through the nozzles. A heater, which is positioned near nozzles, heats the ink so that the ink is discharged through the nozzles during printing. Driving pulses are applied to the heater to discharge the ink through the nozzles.

Printing quality of an inkjet printer depends on the states of the nozzles. In other words, if the nozzles are not used for an extended period of time or if ink is continuously discharged, the nozzles may become clogged or contamination of ink may occur, which may result in a deterioration of printing quality. Thus, a general inkjet printer performs maintenance operations, i.e., spitting, wiping, and capping operations, before or during printing to prevent clogging of nozzles or contamination of ink. That is, for smooth flow of ink through the nozzles, the general inkjet printer discharges ink in the spitting operation, wipes the nozzles in the wiping operation, and caps the nozzles in the capping operation.

FIG. 1 illustrates conventional maintenance operations performed for several situations. When a printer is reset or a new head is installed in a printer, maintenance is performed, including a wiping action that is performed once and a spitting action that is performed a predetermined number of times "A," depending on the manufacturer of the printer. In FIG. 1 at 100, the wiping and spitting sequence is performed twice.

If a user gives a maintenance command to the printer, the wiping action is performed once and the spitting action is performed a predetermined number of times "B," depending on the manufacturer. At 110 of FIG. 1, the wiping and spitting sequence is performed three times.

If a printing command is given to the printer, the wiping action is performed once and the spitting action is performed a predetermined number of times "C," depending on the manufacturer. At 120 of FIG. 1, the wiping and spitting sequence is performed once before printing is performed on each page.

At 130 of FIG. 1, after printing is finished on a designated line, the wiping action is performed once and the spitting action is performed a predetermined number of times "X" during color printing, and the wiping action is performed once and the spitting action is performed a predetermined number of times "Y" during mono printing.

At 140 of FIG. 1, after a predetermined period of time elapses in a machine idle state, the same maintenance operations are carried out as those at 100 of FIG. 1.

FIG. 2 is a flowchart explaining a process of performing conventional maintenance operations.

When a printer is reset due to the supply of power to the printer or the installation of a new head in the printer, in step 200, basic maintenance operations are performed for the nozzles of the head at 200 that are the same as the operations performed at 100 of FIG. 1.

At 210 of FIG. 2, if a user gives a maintenance command to the printer during printing using a command contained in printer driver software to improve printing quality, then, at 220 of FIG. 2, maintenance operations are performed that are the same as the operations performed at 100 of FIG. 1.

At 230 of FIG. 2, the same maintenance operations performed at 120 of FIG. 1 are performed before printing starts on each page to maintain uniform printing quality.

After printing is finished or the printer interfaces with a computer for a predetermined period of time, the same maintenance operations performed at 140 of FIG. 1 are performed at 240 of FIG. 2.

In the above-described maintenance operations, to control the maintenance operations, an amount of ink is measured by counting the pulses for driving the heater. However, if the heater operates abnormally, even when ink is not discharged, pulses may still be counted to measure the amount of discharged ink, resulting in performance of maintenance operations. As a result, improper maintenance operations may be carried out. For example, after printing every other line, spitting and wiping are carried out. However, if a large amount of ink has already been discharged, no ink may be left for the subsequent maintenance operations. Thus, maintenance operations such as spitting may not be performed even when required, and thus uniform printing quality may not be obtained on each page.

SUMMARY OF THE INVENTION

It is an aspect of the present invention to provide an apparatus and method for detecting an amount of ink discharged from a printer so that the printer performs proper maintenance operations.

Additional aspects and/or advantages of the invention will be set forth in part in the description that follows and, in part, will be obvious from the description, or may be learned by practice of the invention.

To achieve the above and/or other aspects of the present invention, there is provided an apparatus detecting an amount of ink discharged by a printer, the printer having a plurality of heaters and corresponding nozzles and performing printing by applying pulses to the heaters to heat the heaters and discharge ink through the corresponding nozzles, the apparatus including a detector connected to the heaters that detects a state change of the heaters and output a state change signal; and an ink discharge amount calculator that calculates an amount of discharged ink corresponding to the state change output signal from the detector.

The detector is a current detecting sensor that detects a current flowing through the heaters.

The detector is a resistance connected in series between a predetermined power source supplying power to the heaters and the heaters.

The ink discharge amount calculator includes a converter and an integrator. The converter converts the state change signal output from the detector into an amount of discharged ink. The integrator accumulates the amount of discharged ink and previous amounts of discharged ink.

The ink discharge amount calculator may further include a comparator that compares the total amount of discharged ink obtained from the integrator with a predetermined threshold amount of ink in the printer.

To achieve the above and/or other aspects of the present invention, there is provided an apparatus detecting an amount of ink discharged by a printer, the printer having a plurality of heaters and corresponding nozzles and performing printing by applying pulses to the heaters to heat the heaters and discharge ink through the corresponding nozzles, the apparatus comprising: a detector connected to the heaters that detects a state change of the heaters and output a state change signal; and an ink discharge amount calculator that calculates an actual amount of discharged ink using the state change signal output from the detector; and a controller that controls a maintenance operation when the actual amount of discharged ink calculated by the ink discharge amount calculator exceeds a predetermined threshold amount of ink to reduce the amount of ink discharged during maintenance.

The detector is a current detecting sensor that detects a current flowing through the heaters.

The detector is a resistance connected in series between a predetermined power source supplying power to the heaters and the heaters.

The ink discharge amount calculator includes a converter and an integrator. The converter converts the state change signal output from the detector into an amount of discharged ink. The integrator accumulates the amount of discharged ink and previous amounts of discharged ink.

The ink discharge amount calculator may further include a comparator that compares a total amount of discharged ink obtained from the integrator with a predetermined threshold amount of ink.

When the total amount of discharged ink exceeds the predetermined threshold amount of ink, the controller controls the maintenance of the printer to reduce the amount of discharged ink.

To achieve the above and/or other aspects of the present invention, there is also provided a method of detecting an amount of discharged ink in a printer using an ink discharge amount detecting apparatus, the printer having a plurality of heaters and corresponding nozzles and performing printing by applying pulses to the heaters to discharge ink through the corresponding nozzles, the method including detecting changes in a state of each of the heaters; calculating an amount of discharged ink corresponding to the changes in the state of each of the heaters; and cumulating each amount of discharged ink.

Detecting the changes in the state of the heaters includes detecting a current flowing through the heaters.

To achieve the above and/or other aspects of the present invention, there is provided a method of detecting an amount of discharged ink in a printer using an ink discharge amount detecting apparatus, the printer having a plurality of heaters and corresponding nozzles and performing printing by applying pulses to the heaters to discharge ink through the corresponding nozzles, the method including detecting changes in a state of each of the heaters; calculating an amount of discharged ink corresponding to the changes in the state of each of the heaters; calculating a cumulative amount of discharged ink; comparing the cumulative amount of discharged ink with a predetermined threshold amount; and controlling maintenance operations to adjust the amount of discharged ink when the cumulative amount of discharged ink exceeds the predetermined threshold amount.

Detecting the changes in the state of the heaters includes detecting a current flowing through the heaters.

Calculating the amount of discharged ink includes comparing an amount of current flowing through the heaters with a predetermined current value.

To achieve the above and/or other aspects according to the present invention, there is provided an apparatus controlling an amount of ink discharged by a printer, including a power supply; a nozzle heating unit having a plurality of nozzle heaters; a current detecting sensor connected between the power supply and the nozzle heating unit, receiving power from the power supply, detecting changes in current flowing through the nozzle heaters, and outputting a current change signal; an ink discharge amount calculator calculating an amount of discharged ink using the current change signal; and a controller controlling maintenance operations when the amount of calculated discharged ink exceeds a predetermined threshold amount of ink to reduce the amount of ink discharged during maintenance by providing driving pulses to the nozzle heating unit to drive the nozzle heaters.

These, together with other aspects and/or advantages that will be subsequently apparent, reside in the details of construction and operation as more fully hereinafter described and claimed, reference being had to the accompanying drawings forming a part thereof, wherein like numerals refer to like parts throughout.

BRIEF DESCRIPTION OF THE DRAWINGS

These and/or other aspects and advantages of the invention will become apparent and more readily appreciated from the following description of the preferred embodiments, taken in conjunction with the accompanying drawings, of which.

DETAILED DESCRIPTION OF THE PREFERRED EMBODIMENT

Figure 1:
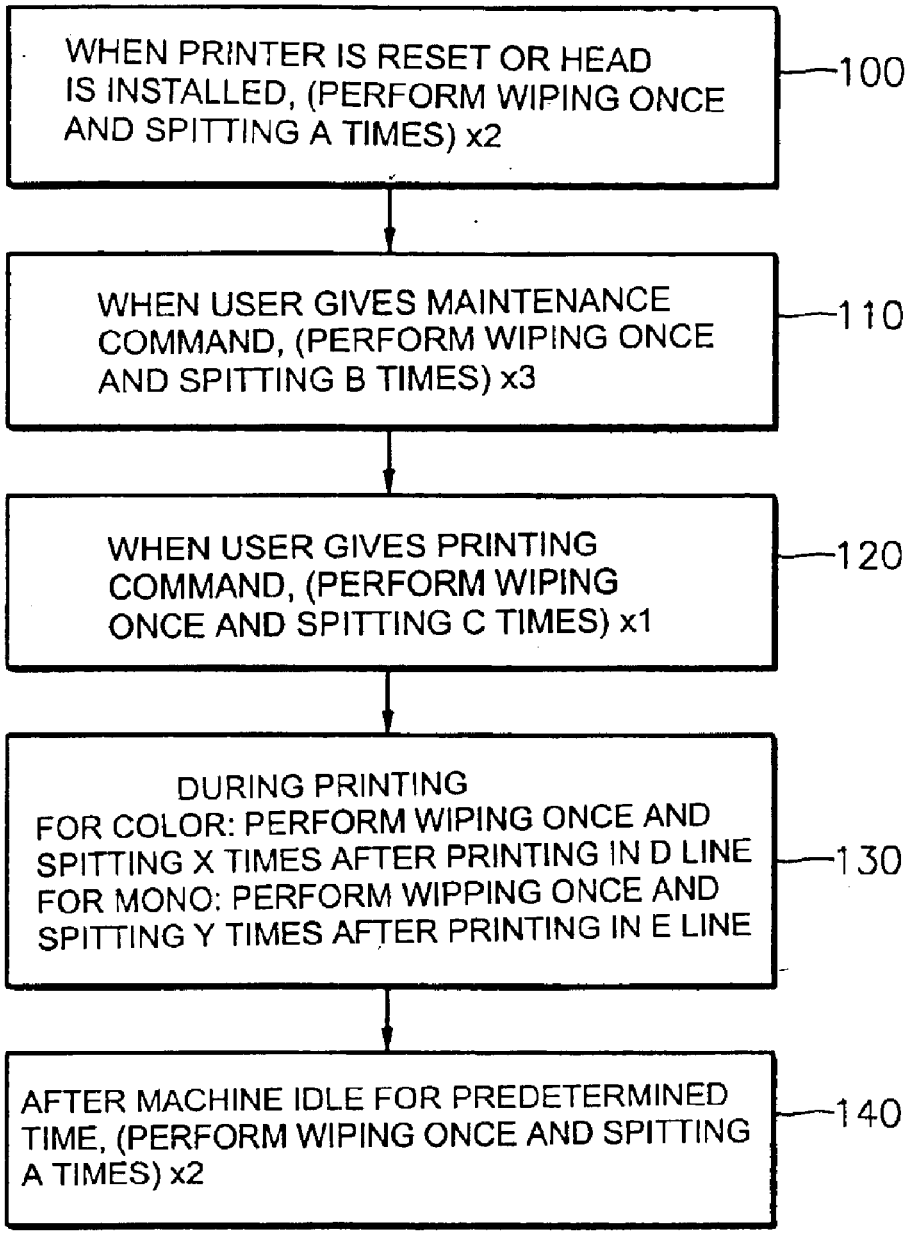
FIG. 1 illustrates conventional maintenance operations for a printer.
Figure 2:
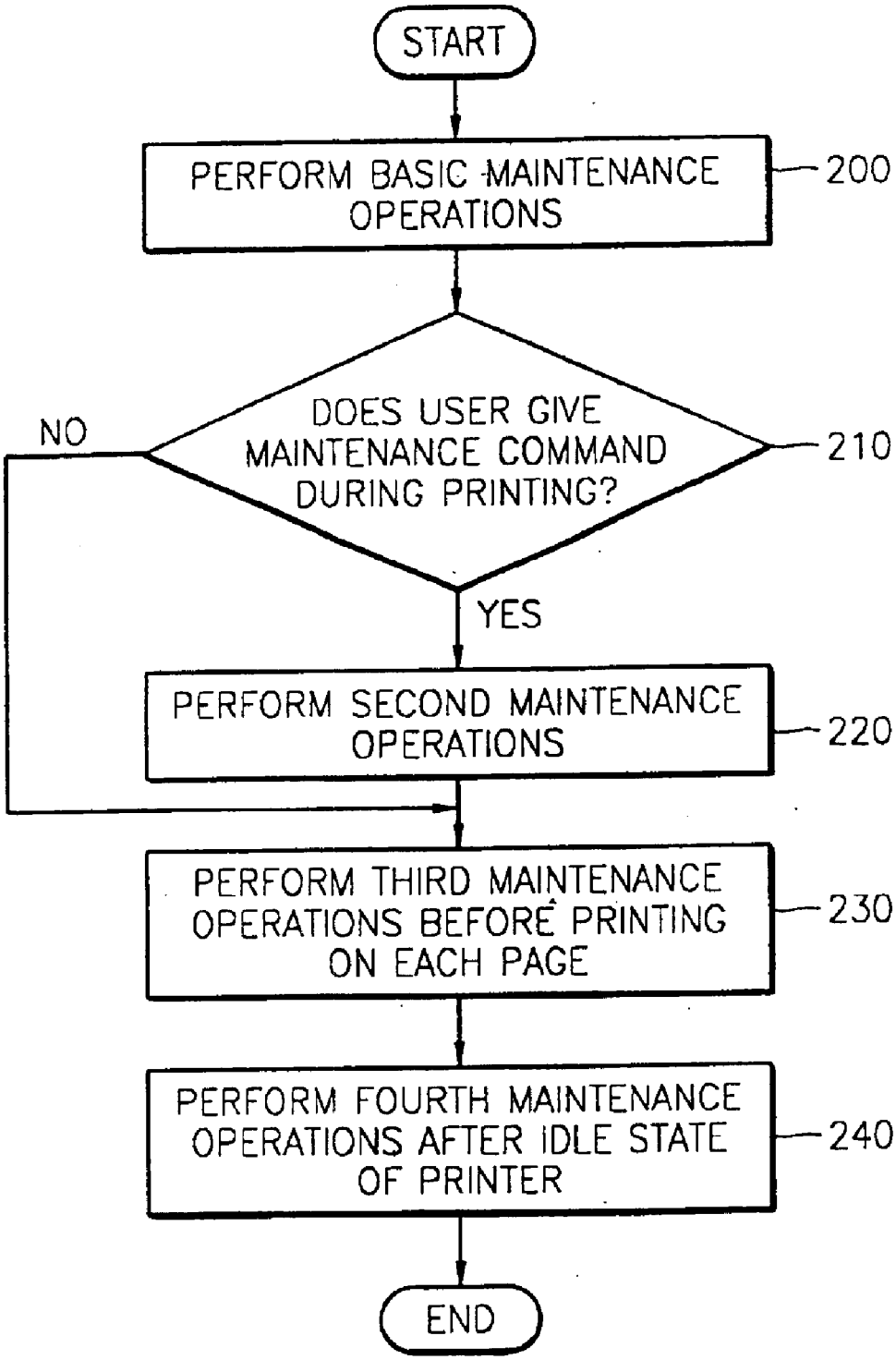
FIG. 2 is a flowchart of processes for performing conventional maintenance operations.

Hereinafter, an embodiment of the present invention will be described in detail with reference to the attached drawings, wherein like reference numerals refer to the like elements throughout. The present invention may, however, be embodied in many different forms and should not be construed as being limited to the embodiment set forth herein; rather, this embodiment is provided so that the present disclosure will be thorough and complete, and will fully convey the concept of the invention to those skilled in the art.

Figure 3:
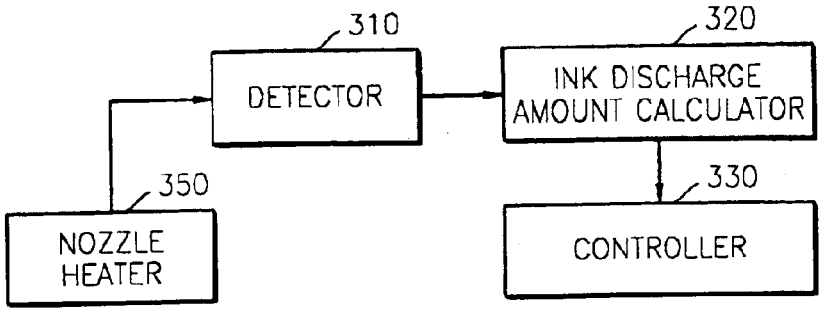
FIG. 3 is a block diagram of an apparatus for detecting an amount of discharged ink to control the maintenance of a printer according to an embodiment of the present invention.

FIG. 3 is a block diagram of an apparatus for detecting an amount of discharged ink to control the maintenance of a printer according to an embodiment of the present invention. Referring to FIG. 3, a printer maintenance controlling apparatus having a nozzle heater 350 includes a detector 310, an ink discharge amount calculator 320, and a controller 330.

The detector 310 detects changes in the state of the nozzle heater 350, such as changes in current flowing through the nozzle heater 350 and changes in the nozzle heater voltage.

The ink discharge amount calculator 320 calculates an amount of discharged ink corresponding to a state change signal of the nozzle heater 350 detected by the detector 310. A level of a signal (generally a current signal), which is supplied to heat the nozzle heater 350, has an initial value. Thus, changes in the state of the signal, such as changes in current flowing through the nozzle heater 350, are measured and the measured results are accumulated, so that an amount of discharged ink can be determined. The ink discharge amount calculator 320 may determine whether the accumulated amount of discharged ink exceeds a predetermined threshold amount.

The controller 330 controls a maintenance operation of the printer based on the amount of discharged ink calculated by the ink discharge amount calculator 320. In particular, the controller 300 adjusts maintenance operations related to the consumption of ink to prevent ink from unnecessarily being discharged. Therefore, improved printing quality can be achieved by controlling the maintenance function based on the consumed amount of ink.

Figure 4:
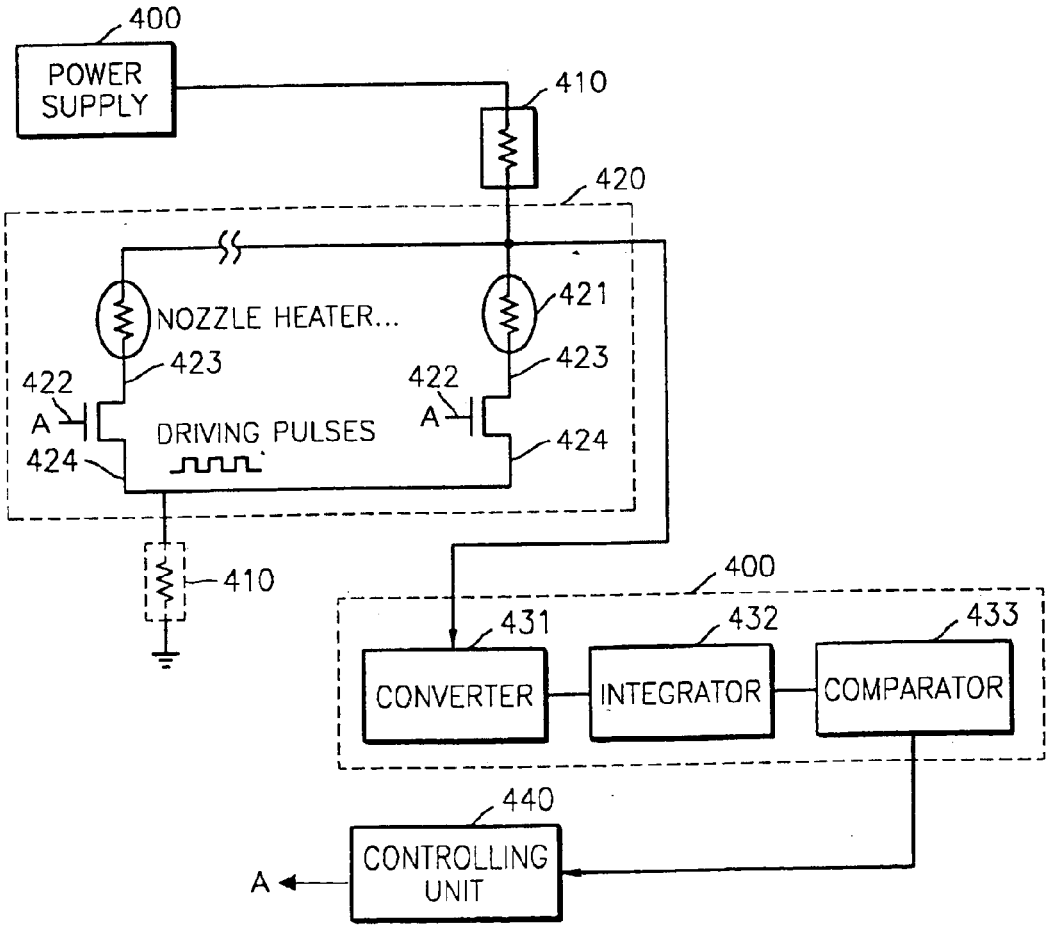
FIG. 4 is a block diagram of a printer maintenance controlling apparatus according to the embodiment of the present invention.

FIG. 4 is a block diagram of a printer maintenance controlling apparatus according to the embodiment of the present invention. Referring to FIG. 4, the printer maintenance controlling apparatus includes a power supply 400, a current detecting sensor 410, a nozzle heating unit 420, an ink discharge amount calculator 430, and a controlling unit 440.

The power supply 400 provides power to the driving heaters 421 of the nozzle heating unit 420.

The current detecting sensor 410 is placed in series with the heaters such that current is detected only when the heaters 421 of the nozzle heating unit 420 are driven. In other words, when the heaters 421 are driven by pulses applied to bases 422 of a plurality of switches, the current detecting sensor 410 is located near sources 423 or drains 424 of the plurality of switches. Thus, when current flows through the heaters 421, the current also flows through the current detecting sensor 410, and thus the current detecting sensor 410 detects the current flowing through the heaters 421.

The nozzle heating unit 420 drives the heaters 421 using pulses supplied from the controlling unit 440. As the heaters 421 are driven, ink is discharged through nozzles (not shown).

The ink discharge amount calculator 430 calculates an amount of discharged ink from a current signal output from the current detecting sensor 410. The ink discharge amount calculator 430 includes a converter 431, which converts current detected by the current detecting sensor 410 into an amount of discharged ink, and an integrator 432, which accumulates the amount of discharged ink converted by the converter 431. The ink discharge amount calculator 430 further includes a comparator 432, which compares the cumulative amount of discharged ink with a predetermined threshold amount and outputs the comparison result.

The controller 440 controls the maintenance of the printer based on the amount of discharged ink calculated by the ink discharge amount calculator 430. In particular, the controller 440 adjusts maintenance operations related to the consumption of ink to prevent ink from unnecessarily being discharged. Therefore, improved printing quality can be maintained by controlling the maintenance operations according to the consumption of ink.

Figure 5:
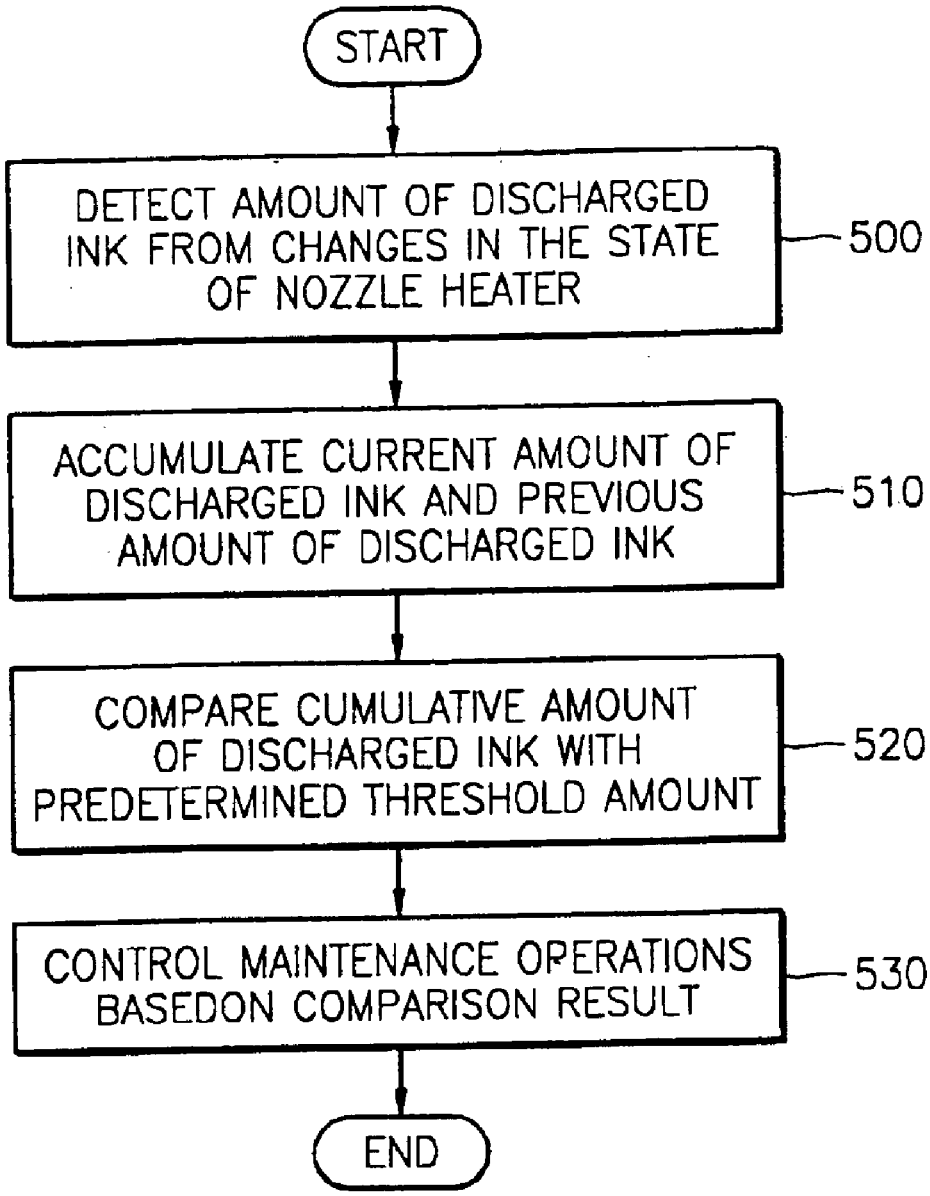
FIG. 5 is a flowchart of a method of detecting an amount of discharged ink to control the maintenance of a printer according to the embodiment of the present invention.

FIG. 5 is a flowchart of a method of detecting an amount of discharged ink to control the maintenance of a printer according to the embodiment of the present invention.

A method of detecting an amount of discharged ink will be described with reference to FIGS. 3 and 4. At 500 of FIG. 5, changes in the state of the nozzle heating unit 420 are detected. If the heaters 421 of the nozzle heating unit 420 are malfunctioning, the heaters 421 may not operate at all or may operate abnormally although pulses are supplied to drive the heaters 421. According to the related art, in this case, because an amount of discharged ink is calculated by counting only pulses supplied from the controller 440, the actual driving state of the heaters 421 may not be checked. In other words, an amount of discharged ink in response to the actual driving of the heaters 421 may not be accurately calculated. However, according to the present invention, an amount of discharged ink can be detected based on the actual driving state of the heaters 421 by detecting changes in the state of the heaters 421. In one instance, the amount of discharged ink corresponding to the actual flow of current through the heaters 421 is calculated based on a predetermined amount of current and an amount of discharged ink corresponding thereto.

After the amount of discharged ink is detected from the state of the heaters 421 at 510 of FIG. 5, a current amount of discharged ink and a previous amount of discharged ink are accumulated. Then, the following steps are performed to control the maintenance of the printer.

At 520 of FIG. 5, the cumulative amount of discharged ink is compared with a predetermined threshold amount.

Whether the cumulative amount of discharged ink exceeds the predetermined threshold amount is determined and maintenance operations are adjusted at 530 of FIG. 5 to control the discharge of ink remaining in the printer based on the comparison result. The maintenance operations for controlling the discharge of ink vary with design.

As described above, according to the present invention, an amount of discharged ink can be calculated based on the actual driving state of nozzle heaters of a printer. As a result, maintenance operations related to discharging of ink can be effectively controlled.

Although an embodiment of the present invention has been shown and described, it will be appreciated by those skilled in the art that changes may be made in this embodiment without departing from the principles and spirit of the invention, the scope of which is defined in the claims and their equivalents.

What is claimed is:

1. An apparatus detecting an amount of ink discharged by a printer, the printer having a plurality of heaters and corresponding nozzles and performing printing by applying pulses to the heaters to heat the heaters and discharge ink through the corresponding nozzles, the apparatus comprising:

a detector connected to the heaters that detects a state change of the heaters and outputs a state change signal; and an ink discharge amount calculator that calculates an amount of discharged ink corresponding to the state change output signal from the detector.

2. The apparatus of claim 1, wherein the detector is a current detecting sensor that detects a current flowing through the heaters.

3. The apparatus of claim 2, further comprising a plurality of switches each having a source, a drain, and a base, each source being connected to a respective one of the heaters, and wherein the current detecting sensor is connected to the sources or to the drains to detect current flowing through the heaters when pulses are applied to the bases of the switches.

4. The apparatus of claim 1, wherein the detector is a resistance connected in series between a predetermined power source supplying power to the heaters and the heaters.

5. The apparatus of claim 1, wherein the ink discharge amount calculator comprises:

a converter that converts the state change signal output from the detector into an amount of discharged ink; and an integrator that accumulates the amount of discharged ink and previous amounts of discharged ink.

6. The apparatus of claim 5, wherein the ink discharge amount calculator further comprises a comparator that compares a total amount of discharged ink obtained from the integrator with a predetermined threshold amount of ink.

7. An apparatus detecting an amount of ink discharged by a printer, the printer having a plurality of heaters and corresponding nozzles and performing printing by applying pulses to the heaters to heat the heaters and discharge ink through the corresponding nozzles, the apparatus comprising:

a detector connected to the heaters that detects a state change of the heaters and outputs a state change signal; and an ink discharge amount calculator that calculates an actual amount of discharged ink using the state change signal output from the detector; and a controller that controls a maintenance operation when the actual amount of discharged ink calculated by the ink discharge amount calculator exceeds a predetermined threshold amount of ink to reduce the amount of ink discharged during maintenance.

8. The apparatus of claim 7, wherein the detector is a current detecting sensor that detects a current flowing through the heaters.

9. The apparatus of claim 7, wherein the detector is a resistance connected in series between a predetermined power source supplying power to the heaters and the heaters.

10. The apparatus of claim 7, wherein the ink discharge amount calculator comprises:

a converter that converts the state change signal output from the detector into an amount of discharged ink; and an integrator that accumulates the amount of discharged ink and previous amounts of discharged ink.

11. The apparatus of claim 10, wherein the ink discharge amount calculator further comprises a comparator that compares a total amount of discharged ink obtained from the integrator with a predetermined threshold amount of ink.

12. The apparatus of claim 11, wherein when the total amount of discharged ink exceeds the predetermined threshold amount of ink, the controller controls the maintenance of the printer to reduce the amount of discharged ink.

13. A method of detecting an amount of discharged ink in a printer using an ink discharge amount detecting apparatus, the printer having a plurality of heaters and corresponding nozzles and performing printing by applying pulses to the heaters to discharge ink through the corresponding nozzles, the method comprising:

detecting changes in a state of each of the heaters;

calculating an amount of discharged ink corresponding to the changes in the state of each of the heaters; and cumulating each amount of discharged ink.

14. The method of claim 13, wherein said detecting changes in a state of each of the heaters comprises detecting a current flowing through the heaters.

15. A method of detecting an amount of discharged ink in a printer using an ink discharge amount detecting apparatus, the printer having a plurality of heaters and corresponding nozzles and performing printing by applying pulses to the heaters to discharge ink through the corresponding nozzles, the method comprising:

detecting changes in a state of each of the heaters;

calculating an amount of discharged ink corresponding to the changes in the state of each of the heaters;

calculating a cumulative amount of discharged ink;

comparing the cumulative amount of discharged ink with a predetermined threshold amount; and controlling maintenance operations to adjust the amount of discharged ink when the cumulative amount of discharged ink exceeds the predetermined threshold amount.

16. The method of claim 15, wherein said detecting the changes in a state of each of the heaters comprises detecting a current flowing through the heaters.

17. The method of claim 16, wherein said calculating an amount of discharged ink comprises comparing an amount of current flowing through the heaters with a predetermined current value.

18. An apparatus controlling an amount of ink discharged by a printer, comprising:

a power supply;

a nozzle heating unit having a plurality of nozzle heaters;

a current detecting sensor connected between the power supply and the nozzle heating unit, receiving power from the power supply, detecting changes in current flowing through the nozzle heaters, and outputting a current change signal;

an ink discharge amount calculator calculating an amount of discharged ink using the current change signal; and a controller controlling maintenance operations when the amount of calculated discharged ink exceeds a predetermined threshold amount of ink to reduce the amount of ink discharged during maintenance by providing driving pulses to the nozzle heating unit to drive the nozzle heaters.

* * * * *